US012553421B2

(12) United States Patent
Abdo et al.

(10) Patent No.: US 12,553,421 B2
(45) Date of Patent: Feb. 17, 2026

(54) FLUID COMPRESSION APPARATUS AND METHOD

(71) Applicant: L'Air Liquide, Societe Anonyme pour l'Etude et l'Exploitation des Procedes Georges Claude, Paris (FR)

(72) Inventors: Youssef Abdo, Jouy-en-Josas (FR); Gaetan Coleiro, Sassenage (FR); Cyril Benistand-Hector, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 19/030,109

(22) Filed: Jan. 17, 2025

(65) Prior Publication Data

US 2025/0237201 A1 Jul. 24, 2025

(30) Foreign Application Priority Data

Jan. 22, 2024 (FR) ..... FR 2400587

(51) Int. Cl.
*F04B 3/00* (2006.01)
*F04B 15/08* (2006.01)
*F04B 53/12* (2006.01)

(52) U.S. Cl.
CPC ..... *F04B 3/00* (2013.01); *F04B 15/08* (2013.01); *F04B 2015/0822* (2013.01); *F04B 53/12* (2013.01)

(58) Field of Classification Search
CPC .... F04B 41/02; F04B 3/00–003; F04B 1/126; F04B 19/06; F04B 2015/081–0826;
(Continued)

(56) References Cited

U.S. PATENT DOCUMENTS 1,166,098 A * 12/1915 Watson ..... F04B 3/003 417/400
2,054,710 A * 9/1936 Okada ..... F04B 23/023 417/493

(Continued)

FOREIGN PATENT DOCUMENTS

CN 111997861 A * 11/2020 ..... F04B 53/143
CN 116335911 A * 6/2023 ..... F04B 15/08

(Continued)

OTHER PUBLICATIONS

French Search Report for FR 2 400 587, mailed May 29, 2024.

*Primary Examiner* — Thomas Fink
(74) *Attorney, Agent, or Firm* — Justin K. Murray

(57) ABSTRACT

The invention relates to a fluid compression apparatus and method comprising first and second compression chambers, an intake system into the first chamber, a transfer system from the first chamber to the second chamber, a piston for ensuring the compression of the fluid in the first and second chambers, and an orifice for discharging the compressed fluid, the intake system comprising one or more valves, the apparatus further comprising a discharge orifice allowing communication between the first compression chamber and the bath to allow surplus liquid trapped in the first compression chamber to leave during a compression movement of the piston in the first compression chamber, the apparatus comprising a discharge valve configured to control the discharge of liquid via the discharge orifice and to prevent fluid from entering the compression chamber via the discharge orifice.

10 Claims, 4 Drawing Sheets

(58) Field of Classification Search
CPC ..... F04B 5/00–02; F04B 23/02–028; F04B 37/10; F04B 37/18; F04B 37/20
USPC ..... 417/901
See application file for complete search history.

(56) References Cited

U.S. PATENT DOCUMENTS

| | | | | |
|---|---|---|---|---|
| 3,136,136 | A * | 6/1964 | Gottzmann | F04B 53/008 417/901 |
| 8,991,658 | B2 * | 3/2015 | Saito | F25D 17/02 222/207 |
| 12,092,098 | B2 | 9/2024 | Benistand-Hector et al. | |
| 12,188,461 | B2 | 1/2025 | Benistand-Hector et al. | |
| 2016/0281690 | A1 * | 9/2016 | Coldren | F04B 19/003 |
| 2019/0145392 | A1 * | 5/2019 | Brown | F04B 23/021 417/379 |

FOREIGN PATENT DOCUMENTS

| | | | | |
|---|---|---|---|---|
| EP | 0294322 | A2 * | 12/1988 | F04B 15/06 |
| EP | 2 687 793 | | 1/2014 | |
| FR | 3 107 572 | | 8/2021 | |
| FR | 3 107 573 | | 8/2021 | |
| FR | 3 115 569 | | 4/2022 | |
| JP | 2012 163 105 | | 8/2012 | |
| KR | 20220140832 | A * | 10/2022 | F04B 3/00 |
| WO | WO-2021164899 | A1 * | 8/2021 | F04B 15/08 |
| WO | WO-2022084021 | A1 * | 4/2022 | F04B 15/08 |

* cited by examiner

[Fig. 1]
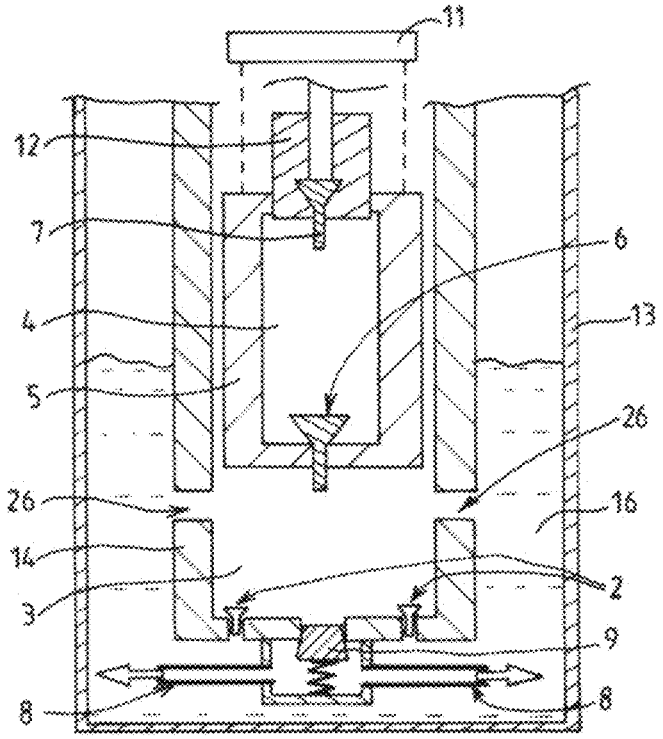
[Fig. 2]
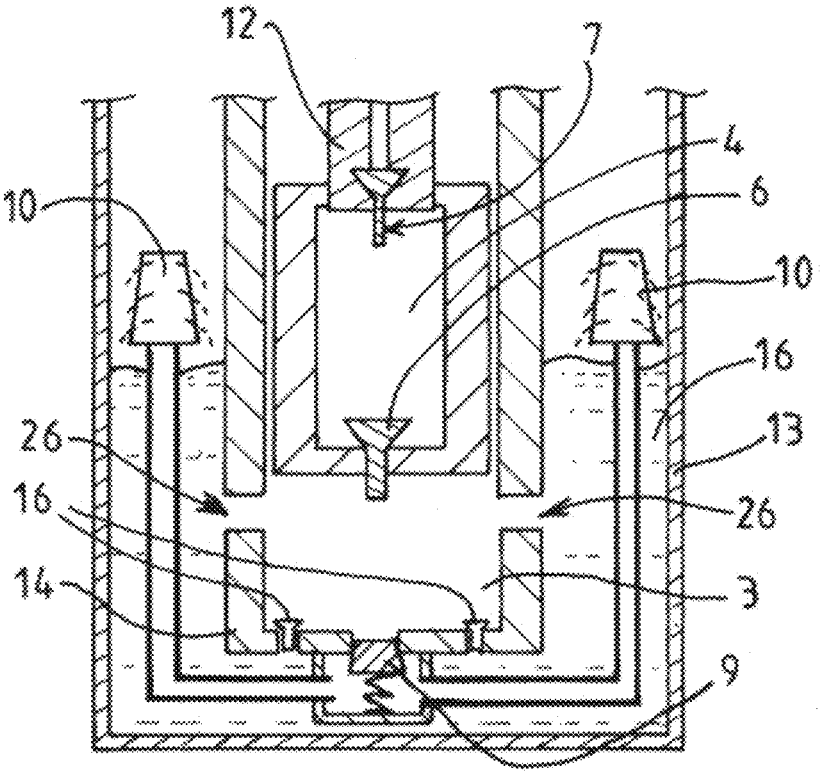

[Fig. 3]
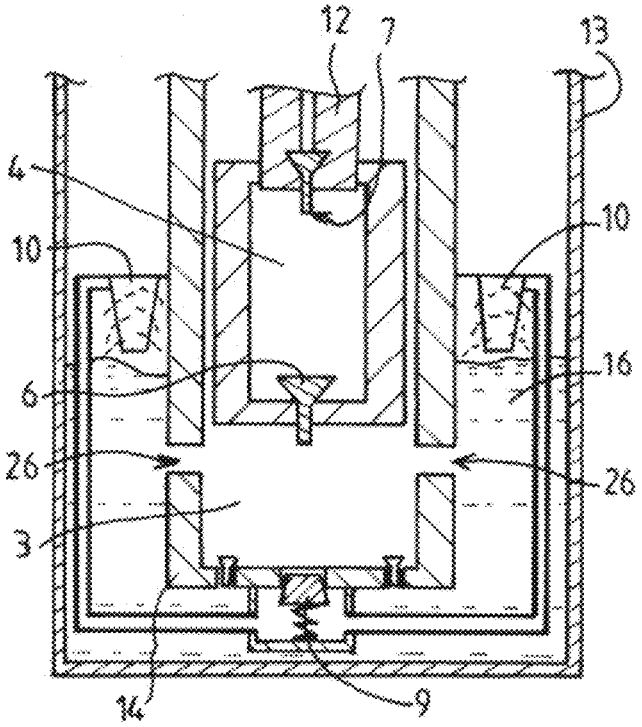
[Fig. 4]
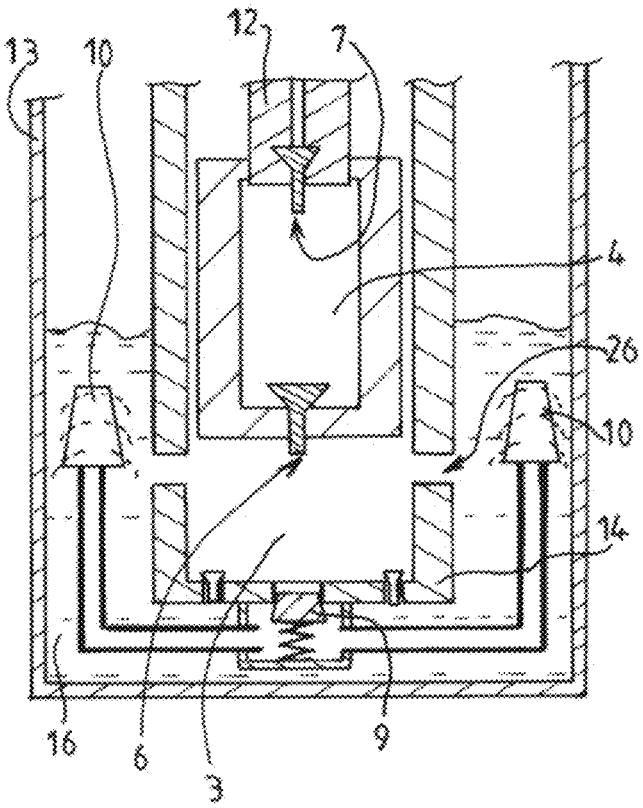

[Fig. 5]
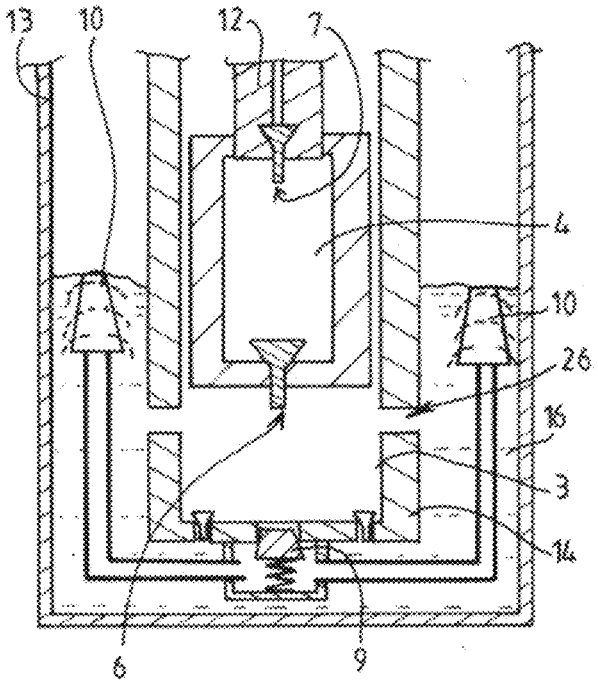
[Fig. 6]
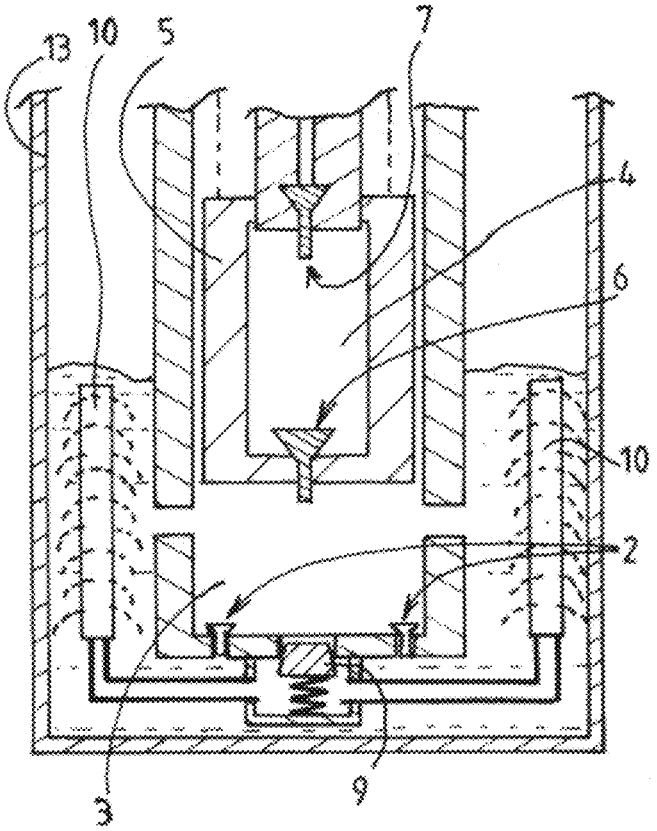

[Fig. 7]
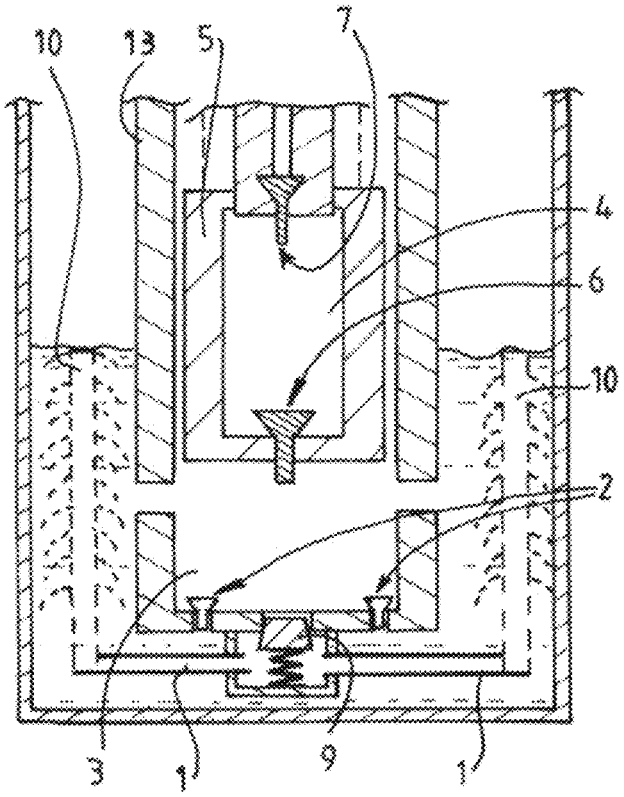
[Fig. 8]
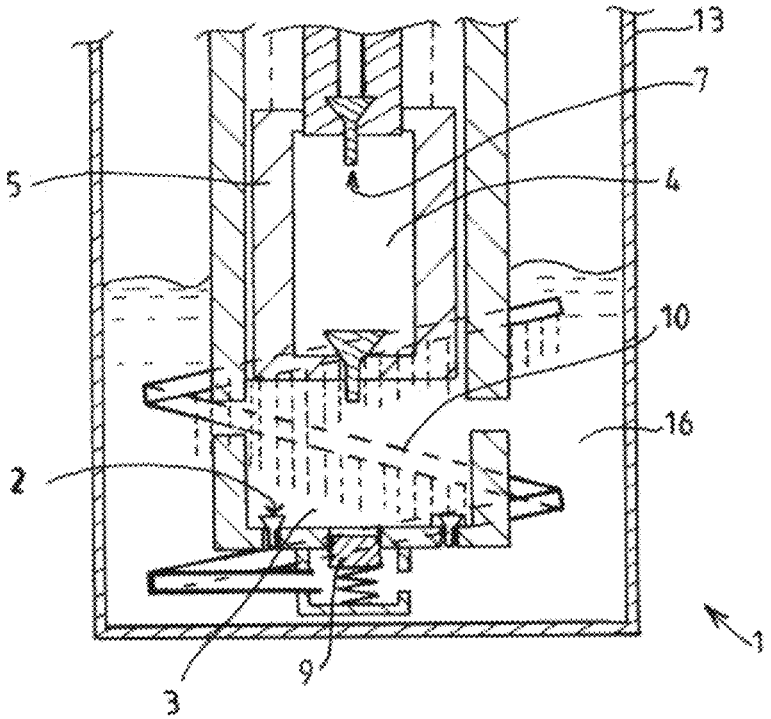

FLUID COMPRESSION APPARATUS AND METHOD

CROSS REFERENCE TO RELATED APPLICATIONS

This application claims the benefit of priority under 35 U.S.C. § 119 (a) and (b) to French patent application No. FR2400587, filed Jan. 22, 2024, which is herein incorporated by reference in its entirety.

FIELD OF THE INVENTION

The invention relates to a fluid compression apparatus and method.

BACKGROUND OF THE INVENTION

To increase the performance and volumetric efficiency of liquid hydrogen pumps, it is essential to have a good thermodynamic quality of the liquid at the intake. This is to avoid cavitation by pressure drop and thermal input. The high-pressure compression of the liquid drawn from a tank containing the pump (bath or sump) is often preceded by a first compression stage (or pre-compression). This pre-compression is generally a compression stage with a lower rate than the second compression stage. This first compression stage draws in quasi-saturated liquid at the saturation temperature of the bath and mechanically subcools it by pressurization in order to achieve good filling without "flash" vaporization at the compression stage.

If the two compression stages are produced by opposite movements of a single piston, the phase of filling the second compression stage therefore takes place at the same time as the compression in the first stage.

Since the diameters of the chambers are different but the piston stroke is identical, the swept volumes can therefore be different (typically the first stage has a larger volume than the second stage). Assuming that the density of the fluid remains relatively constant (because there is little compressibility in the absence of flash vaporization) during the admission into the second stage, it may be essential to discharge some of the pressurized liquid from the first compression chamber.

It is known practice to provide ports or channels connecting the first compression chamber and the bath so as to naturally discharge this surplus fluid to the bath.

This solution is not entirely satisfactory. This discharge of excess liquid from the first compression stage can generate vaporization gas in the bath.

One aim of the present invention is to overcome all or some of the drawbacks of the prior art set out above.

SUMMARY OF THE INVENTION

In certain embodiments, the invention relates more particularly to a fluid compression apparatus with a plurality of compression stages, comprising a sealed enclosure intended to contain a bath of cryogenic fluid having a liquid phase, the upper part of the enclosure being intended to contain a gas headspace, a first compression chamber, a second compression chamber, an intake system that communicates with the first compression chamber and is configured to allow fluid for compression to enter said first compression chamber, a transfer system that communicates with the first and second compression chambers and is configured to allow the transfer of fluid from the first compression chamber to the second compression chamber, and a movable piston for ensuring the compression of the fluid in the first and second compression chambers, the apparatus also comprising a discharge orifice that communicates with the second compression chamber and is configured to allow compressed fluid to leave, the second compression chamber being delimited by a portion of the body of the piston and fixed wall of the apparatus, the piston being able to translate in a first longitudinal direction, wherein the intake system comprises one or more valves configured to ensure that fluid for compression enters the first compression chamber during an intake phase and to prevent fluid from leaving in the compression phase, the apparatus further comprising a discharge orifice allowing communication between the first compression chamber and the bath so as to allow surplus liquid trapped in the first compression chamber to leave during a compression movement of the piston in the first compression chamber.

In an effort to overcome the deficiencies of the prior art discussed, supra, the apparatus according to the invention, which otherwise corresponds to the generic definition given in the preamble above, is configured such that it has a discharge valve configured to control the discharge of liquid via the discharge orifice and to prevent fluid from entering the compression chamber via the discharge orifice.

In addition, embodiments of the invention can comprise one or more of the following features:

- the discharge valve is a non-return valve, for example comprising a shut-off flap acted upon by a spring,
- the discharge orifice communicates with the enclosure via a flow retarder configured to attenuate the speed and/or intensity of the discharged liquid flow by limiting its pressure drop,
- the flow retarder comprises at least one of a nozzle made from porous material and a set of diffusion holes,
- the discharge orifice communicates with the enclosure via at least one discharge duct emerging in the enclosure in the bath so as to be situated in and/or above the bath of the enclosure,
- the discharge duct has a portion extending into the enclosure parallel to the longitudinal direction and/or transverse to the longitudinal direction,
- the discharge duct extends from the bottom towards the top of the enclosure,
- the discharge orifice communicates with the enclosure via a plurality of discharge ducts emerging in the enclosure,
- the container contains a bath consisting of cryogenic liquid, for example liquefied hydrogen.

The invention also relates to a method for pumping cryogenic fluid using such an apparatus, wherein the container contains a bath of liquefied cryogenic fluid, the method comprising, simultaneously during a first movement of the piston, a step of admitting liquid into the first compression chamber via the intake system and a step of compressing fluid in the second compression chamber, and then, during a second opposite movement of the piston, a step of admitting fluid into the second compression chamber via the transfer system and a step of compressing the fluid in the first compression chamber during which surplus fluid is discharged from the first compression chamber via the discharge orifice.

The invention can also relate to any alternative device or method comprising any combination of the features above or below within the scope of the claims.

BRIEF DESCRIPTION OF THE DRAWINGS

The invention will be understood better from reading the following description and from studying the accompanying figures. These figures are given only by way of illustration and do not in any way limit the invention.

FIG. 1 is a schematic and partial view in vertical cross section, illustrating a first exemplary embodiment of an apparatus according to the invention.

FIG. 2 is a schematic and partial view in vertical cross section, illustrating a second exemplary embodiment of an apparatus according to the invention.

FIG. 3 is a schematic and partial view in vertical cross section, illustrating a third exemplary embodiment of an apparatus according to the invention.

FIG. 4 is a schematic and partial view in vertical cross section, illustrating a fourth exemplary embodiment of an apparatus according to the invention.

FIG. 5 is a schematic and partial view in vertical cross section, illustrating a fifth exemplary embodiment of an apparatus according to the invention.

FIG. 6 is a schematic and partial view in vertical cross section, illustrating a sixth exemplary embodiment of an apparatus according to the invention.

FIG. 7 is a schematic and partial view in vertical cross section, illustrating a seventh exemplary embodiment of an apparatus according to the invention.

FIG. 8 is a schematic and partial view in vertical cross section, illustrating an eighth exemplary embodiment of an apparatus according to the invention.

DETAILED DESCRIPTION OF THE INVENTION

Throughout the figures, the same references relate to the same elements.

In this detailed description, the following embodiments are examples. Although the description refers to one or more embodiments, this does not mean that the features apply only to a single embodiment. Individual features of different embodiments can also be combined and/or interchanged to provide other embodiments.

The fluid compression apparatus 1 shown in [FIG. 1] comprises two compression stages in series produced by a single piston 5 driven in alternating movement by a drive member 11.

The apparatus 1 particularly comprises a first compression chamber 3 (at relatively low pressure) and a second compression chamber 4 (at relatively high pressure).

The apparatus 1 comprises an intake system 2 that communicates with the first compression chamber 3 and is configured to allow fluid for compression to enter said first compression chamber 3.

The intake system 2 comprises for example at least one of: one or more non-return valves, one or more orifices or ports, at least one flat-disc valve or any other device or valve that allows fluid for compression to enter the first compression chamber 3 during an intake phase (here, the upstroke of the piston 5) and prevents fluid from leaving in the compression phase (here, the downstroke of the piston 5).

In particular, this intake system 2 (valve(s) and/or the like) can be configured to open in the event of a given pressure differential between its two ends. In addition, the first chamber 3 can optionally be equipped with a relief valve or other safety element configured to limit the pressure within the chamber to below a given safety threshold.

The apparatus 1 also comprises a non-return transfer system 6 that communicates with the first 3 and second 4 compression chambers and is configured to allow the transfer of fluid from the first compression chamber 3 to the second compression chamber 4 (during and/or at the end of the phase of compression of the fluid in the first compression chamber 3) but which remains closed during the compression phase in the second compression chamber 4. This transfer system 6 can be of the same type as the intake system 2.

The apparatus 1 comprises a piston 5 that is able to translate in order to ensure the compression of the fluid in the first 3 and second 4 compression chambers (as detailed hereinafter).

The apparatus 1 further comprises a discharge orifice 7 that communicates with the second compression chamber 4 and is configured to allow high-pressure compressed fluid to leave the second compression chamber 4 (during or at the end of the compression phase in this chamber 4). The discharge orifice 7 can be provided with a non-return system, which can be of the same type as the intake system 2 (for example closed as long as the pressure differential between the second compression chamber 4 and the outside is below a given threshold).

As illustrated, the second compression chamber 4 can be delimited by a portion of the body of the piston 5 and a fixed wall of the apparatus. The piston 5 is able to translate in a longitudinal direction A, for example vertical in an operating configuration.

As illustrated, the piston 5 comprises for example a tubular portion mounted around a fixed central guide 12. A terminal end of the central guide 12 forms for example a fixed wall defining part of the second compression chamber 4. The apparatus 1 comprises a sealing system (not shown for the sake of simplicity) formed between the central guide 12 and the piston 5 (piston ring(s), seal(s) or the like). In the longitudinal direction A of translation of the piston 5, the intake system 2 is preferably situated at a first end of the apparatus 1, the discharge orifice 7 being situated at a second end of the apparatus, and the transfer system 6 is situated between the intake system 2 and the discharge orifice 7.

The discharge orifice 7 can be situated at the lower end of the central guide 12 (the fixed upper end of the second compression chamber 4). The apparatus 1 can comprise a compressed gas discharge duct comprising a first, lower end connected to this discharge orifice 7 and a second, upper end situated in the upper part of the apparatus 1 for collecting the compressed high-pressure fluid.

As illustrated, one end of the piston 5 forms a movable surface for compressing the fluid in the first compression chamber 3 while the tubular portion of the piston 5 forms a movable sleeve that collaborates with the terminal end of the central guide 12 to form a system for compressing the fluid in the second compression chamber 4 (in this second compression stage, the terminal end of the central guide 12 thus forms a fixed piston collaborating with a movable sleeve).

As illustrated, the first compression chamber 3 can be formed in a tubular cavity 14 or fixed chamber that is closed at its lower end. The lower part of the first compression chamber 3 can thus be delimited by this fixed lower cavity 14. The intake system 2 can be situated at a lower end of the lower cavity 14.

The upper part of the first compression chamber 3 can thus be delimited by a lower end of the piston 5 and a sealing system (piston rings or the like) formed between the piston 5 and a wall of the lower cavity 14.

Preferably, the first compression chamber 3 is configured to promote the escape of the gas via the ports or valves. For example, as schematically shown, one or more ports 26 (or orifices) can be formed in the upper part of the lower cavity 14 (or any fixed wall portion defining at least part of the first combustion chamber 3). These ports 26 can be provided so that, when the piston 5 uncovers them (when the piston 5 is above at least some of the ports 26) the first compression chamber 3 communicates with the outside. Thus, in the intake phase (as the chamber 3 is becoming larger), any gas that might be present in the first compression chamber 3 can escape via these ports 26 and give up its place to liquid from the surrounding bath. This ensures complete filling with liquid on intake. In addition, in the compression phase (the piston 5 moving down in the second compression chamber 3), these ports 26 can allow the surplus liquid to escape, thereby metering the volume of liquid trapped therein (this volume can be determined by the longitudinal position of the ports 26). The piston 5 then continues its compression stroke in the first compression chamber 3 and the ports 26 no longer communicate with the compressed volume (which is isolated from the bath 16).

As illustrated, the compression apparatus 1 can comprise a thermally insulated sealed enclosure 13 containing a bath 16 of cryogenic cooling fluid. In particular, the first 3 and second 4 compression chambers can be submerged in a liquid phase. The upper part of the enclosure 16 can have a gas headspace that collects any leaks from the apparatus 1.

The compression apparatus 1 further comprises a discharge orifice 8 that allows fluidic communication between the first compression chamber 3 and the bath 16 and is configured to allow surplus liquid trapped in the first compression chamber 3 to leave during a compression movement of the piston 5 in the first compression chamber 3.

A discharge valve 9 is provided to control the discharge of liquid via the discharge orifice 8 and to prevent fluid from entering the compression chamber 3 via the discharge orifice 8.

The discharge valve 9 is for example a non-return valve, for example comprising a shut-off flap acted upon by a spring to a closed position on a seat.

As illustrated in [FIG. 2] et seq, the discharge orifice 8 preferably communicates with the enclosure 13 via a flow retarder 10 configured to attenuate the speed and/or intensity of the discharged liquid flow by limiting its pressure drop.

The retarder 10 is preferably configured to reduce the effect of pressure drops caused by diffusion or friction or violent shocks due to vigorous discharged jets. The retarder "breaks" such jets.

Such a retarder 10 produces non-sudden discharge of the flow, which loses speed but converts it into pressure rather than into a pressure drop. This limits friction or possible spattering of liquid towards hot areas of the wall of the intake bath that can cause it to evaporate.

The flow retarder 10 can comprise, for example, a nozzle made from porous material, cf. [FIG. 2], [FIG. 3], [FIG. 4] and [FIG. 5]. For example, porous sintered materials can comprise: a sinter made from bronze or stainless steel, for example of cylindrical or conical shape. The length can be between 15 mm and 350 mm. The diameter can be between 10 mm and 45 mm. The permeability can be greater than five darcy (>5 D), one darcy being equal to $10^{-12}$ $m^2$.

This makes it possible to "break" the discharged jet without pressure drop while at the same time reducing the contact of the liquid close to saturation with potentially warmer parts or vapour of the bath 16.

As illustrated, the discharge orifice 8 can communicate with the enclosure 13 via at least one discharge duct 11 (two in the examples illustrated) emerging in the enclosure 13.

The discharge duct(s) 11 can extend:

horizontally, and emerge for example in the lower part of the container, in the liquid bath, cf. [FIG. 1], horizontally and then vertically upwards, and emerge for example in the lower part of the container, in the liquid bath, cf. [FIG. 4], horizontally and then vertically, and emerge for example at the junction between the liquid bath and the gas headspace, cf. [FIG. 5], horizontally and then vertically, and emerge for example above the liquid bath and the gas headspace, cf. [FIG. 2] and [FIG. 3].

If a retarder 10 is provided, it is preferably provided at the downstream end of the discharge duct 11 (in the container/bath).

Thus, as illustrated, the ends of the discharge ducts 11 can be oriented upwards or downwards or horizontally.

In particular, it is possible to orient the discharge duct(s) 11 vertically in order to reduce contact between the potential bubbles and the liquid of the bath 16. In this way, the bubbles are directed rather towards the top of the bath and therefore towards the gas headspace while the liquid flows into the liquid phase.

In the event of discharge into the gas part, the discharged liquid flow can trickle and flow slowly into the liquid phase. In this way the heat exchange between the liquid phase and the gas phase is limited. As illustrated, the two discharge ducts 11 can be connected to a single discharge valve 9 via a common chamber.

In the variant in [FIG. 6], the retarder 10 comprises or consists of a tube with a porous surface that extends vertically in the container 13.

In the variant in [FIG. 7], the retarder 10 comprises or consists of a tube pierced with a multitude of orifices so as to allow the liquid to trickle. For example, the orifices have dimensions of between 0.05 mm and 1 mm.

In the variant in [FIG. 8], the retarder 10 comprises or consists of a tube pierced with a multitude of orifices arranged in a coil around the two compression chambers.

The invention is particularly advantageous for pumping hydrogen, for example so as to produce a flow of hydrogen at very high pressure at the outlet of the second compression stage (pressure between 100 and 1,000 bar for example).

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

The invention claimed is:

1. A fluid compression apparatus with a plurality of compression stages, the fluid compression apparatus further comprising:

a sealed enclosure configured to contain a bath of cryogenic fluid having a liquid phase, the upper part of sealed the enclosure being configured to contain a gas headspace;

a first compression chamber;

a second compression chamber;

an intake system that communicates with the first compression chamber and is configured to allow fluid for compression to enter said first compression chamber;

a transfer system that communicates with the first and second compression chambers and is configured to allow the transfer of fluid from the first compression chamber to the second compression chamber; and a movable piston configured to ensure the compression of the fluid in the first and second compression chambers;

a discharge orifice that communicates with the second compression chamber and is configured to allow compressed fluid to leave;

the second compression chamber being delimited by a portion of the body of the piston and fixed wall of the apparatus;

the piston being able to translate in a first longitudinal direction, wherein the intake system comprises one or more valves configured to ensure that fluid for compression enters the first compression chamber during an intake phase and to prevent fluid from leaving in the compression phase;

a second discharge orifice configured to allow communication between the first compression chamber and the bath so as to allow surplus liquid trapped in the first compression chamber to leave during a compression movement of the piston in the first compression chamber; and a discharge valve configured to control the discharge of liquid via the discharge orifice and to prevent fluid from entering the compression chamber via the discharge orifice, wherein the discharge orifice communicates with the enclosure via at least one discharge duct emerging in the enclosure in the bath so as to be situated in and/or above the bath of the enclosure.

2. The apparatus according to claim 1, wherein the discharge valve is a non-return valve, for example comprising a shut-off flap acted upon by a spring.

3. The apparatus according to claim 1, wherein the discharge orifice communicates with the enclosure via a flow retarder configured to attenuate the speed and/or intensity of the discharged liquid flow by limiting its pressure drop.

4. The apparatus according to claim 3, wherein the flow retarder comprises at least one of a nozzle made from porous material and a set of diffusion holes.

5. The apparatus according to claim 1, wherein the discharge duct has a portion extending into the enclosure parallel to the longitudinal direction and/or transverse to the longitudinal direction.

6. The apparatus according to claim 1, wherein the discharge duct extends from the bottom towards the top of the enclosure.

7. The apparatus according to claim 1, wherein the discharge orifice communicates with the enclosure via a plurality of discharge ducts emerging in the enclosure.

8. The apparatus according to claim 1, wherein the container contains a bath consisting of cryogenic liquid.

9. The apparatus according to claim 8, wherein the cryogenic liquid is liquid hydrogen.

10. A method for pumping cryogenic fluid, the method comprising the steps of:

providing the apparatus as claimed in claim 1, wherein the container contains a bath of liquefied cryogenic fluid;

simultaneously during a first movement of the piston, admitting liquid into the first compression chamber via the intake system and compressing fluid in the second compression chamber, and simultaneously during a second opposite movement of the piston, admitting fluid into the second compression chamber via the transfer system and compressing the fluid in the first compression chamber during which surplus fluid is discharged from the first compression chamber via the discharge orifice.

* * * * *